United States Patent [19]

Young

[11] 4,009,561

[45] Mar. 1, 1977

[54] METHOD OF FORMING CABLES

[75] Inventor: Geoffrey Stanley Young, San Jeronimo, Mexico

[73] Assignee: Camesa, S.A., Lerdo, Mexico

[22] Filed: Sept. 2, 1975

[21] Appl. No.: 609,845

[30] Foreign Application Priority Data

June 2, 1975 Mexico ..... 158666

[52] U.S. Cl. ..... 57/6; 29/728; 57/9; 57/15; 57/161

[51] Int. Cl.[2] ..... D07B 3/04; D07B/3/06

[58] Field of Search ..... 57/3, 6, 57/9, 10, 11, 13–15, 55, 160, 161, 166, 162; 29/203 R, 203 D, 202.5, 435

[56] References Cited

UNITED STATES PATENTS

| | | | |
|---|---|---|---|
| 703,778 | 7/1902 | Frederick | 57/15 |
| 909,709 | 1/1909 | Taylor | 57/15 X |
| 1,934,026 | 11/1933 | Angell et al. | 57/6 |
| 2,434,073 | 1/1948 | Isenberg | 57/6 X |
| 3,138,915 | 6/1964 | Ege | 57/160 |
| 3,164,669 | 1/1965 | Meyerhoff | 57/15 UX |
| 3,368,268 | 2/1968 | Sherman | 29/203 |
| 3,530,661 | 9/1970 | Thomen | 57/162 |
| 3,559,390 | 2/1971 | Staschewski | 57/6 |
| 3,732,679 | 5/1973 | Sohr | 57/6 X |

*Primary Examiner*—John Petrakes
*Attorney, Agent, or Firm*—Ladas, Parry, Von Gehr, Goldsmith & Deschamps

[57] ABSTRACT

The present invention refers to a method of forming cables whether or not all metallic, flexible armored tubes, armored electrical conductors and the like which consists of applying heat to the wires which will form the armor before they are placed around the core and in some cases to all the subsequent layers of a cable having a multiplicity of layers.

7 Claims, 3 Drawing Figures

METHOD OF FORMING CABLES

BACKGROUND OF THE INVENTION

The cables referred to in this invention are those which are constructed by means of applying in a helical manner successive layers of load bearing elements or wires around an initial center member or core. This core may itself be a wire or family of wires; a hydraulic hose or one or more electrically insulated conductors or the like. The lead bearing elements may be metallic wires, plastic fibers, or the like, and may may have round, square, z, or other shaped cross-sections. The finished cable may have one or many successive layers of helical elements applied in the same or opposite directions.

In forming cables of this type of construction, it is common to experience loosening or ballooning of the helical wires during manufacture of the cable and later when load is applied to the cable in use. This loosening is a very serious problem for the manufacturer and in the operation of the cable. This looseness is generated by the compression of the core due to voids in the core or the cusp like voids between the under side of helically applied wires and the cylindrical core assembly.

When load is applied to a cable either during manufacture or in use, the tension of the load bearing elements generate a pressure on the core tending to remove these voids. As the voids are removed by pressure, the effective core diameter is reduced and the helical elements must elongate to accommodate the smaller core diameter. This elongation or increases in length of the cable is a permanent or non elastic elongation of the cable and is very objectionable for applications where these cables are used for accurate length measurements.

A further problem associated with core compression occurs when the cable has more than one layer of load bearing elements. In this case the inner layer of wire will compress the core, but the subsequent layers will not necessarily adjust to this new diameter. The result is that the subsequent layers will possess residual stress causing loose wires, unbalanced torque and the like, which gives the cable unpredictable mechanical characteristics.

One common form of this type of cable is the cable used in oil well logging operations. This cable generally consists of one or more electrically insulated conductors covered with two layers of contra-helically wound wire of high strength steel. This type of cable is used to lower geophysical instruments and tools to depths of 30,000 feet and more and at temperatures up to 800° F. To know the location of the instruments to a depth accuracy of one foot in 10,000 feet it is very important that the cable have elastic stretch characteristics and any permanent or irreversible changes in the cable length in use must be avoided. Because of the great depths and abrasive environment it is also very important that the cable does not have loose armor wires protruding which will wear more rapidly causing premature cable failure.

Consequently, all known manufacturing methods aim at the construction of armored cables which overcome the problems indicated.

For example, a measure often taken by cable manufacturers consist of subjecting the entire length of the finished cable before use, to a prestressing operation. In this operation the completed cable is tensioned and sometimes heated in an attempt to remove the inherent irreversible deformation characteristics normally experienced with this type of cable. However, this solution has not proved satisfactory, because after the prestressing operation the cable possesses stress and torsional unbalance, and in an effort to equalize this unbalance to cable rotates in the well. This rotation generates a permanent and irreversible elongation of the cable and causes inaccurate measurements of depth. Furthermore, the rotation is not determinable because it depends upon the depth and time the cable is left in the well, so that the cable in routine operations never fully stabilizes either its torque stress or its length. This rotation to equalize stress unbalance will also loosen armor wires.

Other known methods in the art deal with correcting the problems of compression of the core, loosening of armor and the residual torque stress, by applying heat, and tension and a rotation to the cables once they are completely assembled. However, all these known methods have not had the success desired, largely because the geometry of the multiple successive layers of armor wires is such that, when the core is compressed after all layers of wire are in place, it is impossible to eliminate all the residual tension and torque stress in each and every one of the layers of armor, without producing the great drawback above referred to of loose armor wires.

OBJECTS OF THE INVENTION

The present invention has as its object to provide a method for forming of cables, whether all metallic or not, flexible armored tubes, armored electrical conductors and the like, by which the cables so produced will not exhibit the voids which are normally formed when wires are spirally surround a cylindrical core. When these voids between the first layer of armor and the core are eliminated, the cable will be nearly incompressible because it will have no voids and will offer a more stable assembly for placing the subsequent layers of armor. Likewise by not having voids between the first layer of armor and the core, there will be no danger of loosening of the outer armor layers and these cables will be better suited for winding. They will also wear less reducing breakage and there will not be excessive rotation due to torsional unbalance generated in manufacturing.

Consequently, the method of the invention includes the following steps: passing a core through a predetermined path; passing the core through a first rotating assembly adapted to apply a plurality of wires; heating a first series of armor wires coming from the first rotating assembly; spirally winding the core with a layer of wire armor; cooling the assembly from the preceding step. In cables with more than one layer of armor wires, this cooled assembly can be passed through subsequent rotating assemblies for applying armor wires; heating in some cases a series of armor wires coming from the subsequent rotating assemblies; winding the heated subsequent series of armor wires around the assembly in the same or opposite direction to that of the previous armor wire layers, to form an assembly of core with one or more armor layers, cooling said assembly of core with one or more armor layer and accumulating the assembly of core with one or more armor layers.

These and other objects to be achieved through the application of this invention will be better understood and apprehended in the following description which refers to the drawings of a typical embodiment of the present invention.

DETAILED DESCRIPTION OF THE INVENTION

The present invention refers to armored cables and more specifically to a method for thermally forming cables 11. The cables may be metallic and may additionally be flexible armored tubes, armored electrical conductors and the like. Particular uses of such cables are to lower instruments for logging geophysical data of oil wells and similar subsurface and marine operations.

Figure 1:
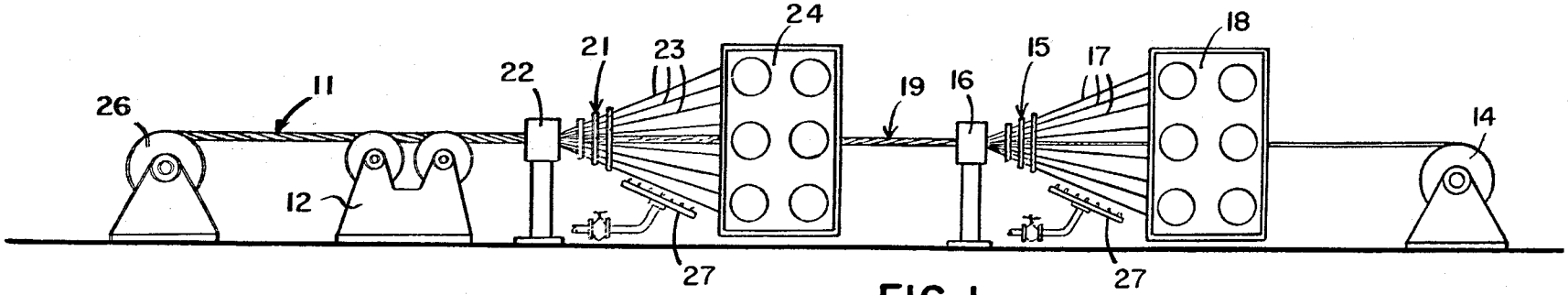
FIG. 1 is a schematic view which illustrates the method for thermally forming of cables whether all metallic or not, flexible armored tubes, armored electrical conductors and the like of the present invention.
Figure 3:
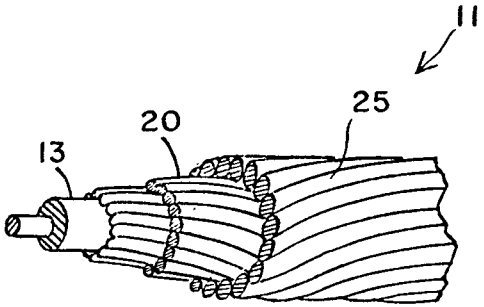
FIG. 3 is a detail view which illustrates a typical cable with double armor layer produced in accordance with the method of the present invention.
Figure 2:
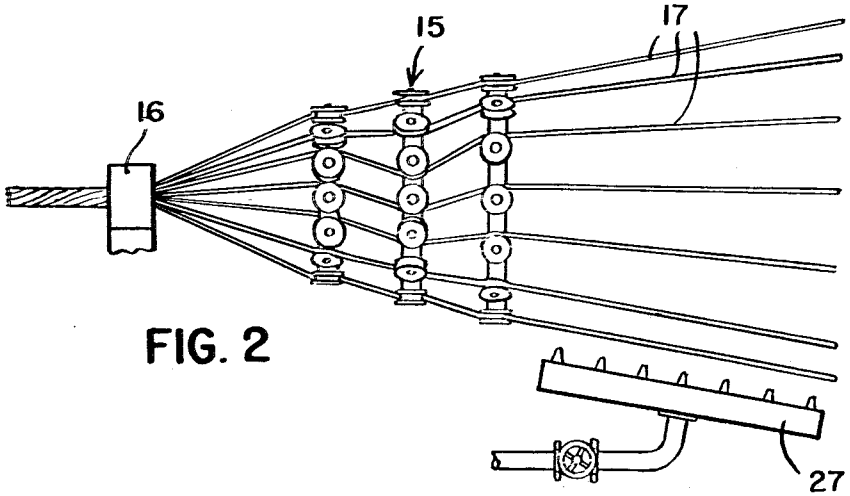
FIG. 2 is a schematic view in detail which illustrates one embodiment for heating the armor wires before they are applied to the core or previous layer of armor wires.

The method of the invention consists of pulling, for example by means of a power driven capstan 12, a core 13 from a pay off spool 14 (see FIG. 1) along a predetermined route of operation. In following the route the core passes through a rotating assembly 18, in some applications a preforming head 15 and closing die 16. A series of heated armor wires 17 drawn from a first rotating assembly 18, which contains spool of armor wires, are placed spirally around the core 13 at the location of the die 16 to form and assembly 19 of core 13 with a first layer of armor 20.

Thereafter the assembly 19 is cooled naturally or optionally by force cooling and is made to pass in some cases through another rotating assembly 24 and in some applications a preforming head 21 in which at another closing die 22 another series of armor wires 23 is placed spirally upon it in the same or opposite direction to that of the armor wires 17 of the first layer 20. The armor wires 23 may in some cases also be heated coming from a second rotating assembly 24 to form an assembly which in this example includes the core 13, the first layer of armor 20 and a second layer of armor 25. In this manner finished cable 11 comprises a double armor layer cable. Finally the cable 11 is wound up on a receiving spool 26.

Heating the series of armor wires 17 and in some cases subsequent layers may be accomplished very simply, for example by means of open flame burners 27 which are placed between the rotating assembles 18 and 24 and the corresponding closing dies 16 and 22. That is, the heating is done before the armor wires 17 and 23 enter the closing die 16 and 22.

Alternatively, heating might be by means of the application of electric current, which would consist of electrically insulating a set of rollers through which the wire would pass, so that when an electric potential is applied between them a current would be forced to pass through the wires, whereby they would be heated. One embodiment of this would be to use the rollers in a preforming head.

Another mode of heating might be carried out by induction, that is, placing a winding around the armor wires or individual wires before the closing die and passing a suitable electric current through the coil.

Still another method of heating is by means of hot gas or liquid. In all methods of heating the wires may be heated individually or collectively.

In the application of heating by any means, the important factors to bear in mind are that the temperature should be high enough to develop sufficient tension when cooled to compress and embed the wires into the core and yet not so high as to anneal the wires or not burn or unduly melt the central core as they are placed around it. Consequently, the exact temperature of the heating will depend on the type of materials of which the core is made. Once these wires have cooled they will contract and compress the core. The most usual temperature values depending on the kinds of cores used will be between 90° and 200° C.

The characteristics which are obtained in armored cables produced by the method of the present invention imbedding the heated wires in the deformable core include the elimination of the cusp-like voids which normally would be fored upon spirally applying armor wires to a cylindrical core. Such voids could be eliminated by means of hot stressing, which as above indicated is extremely undesirable from the point of view of the problem of residual stress unbalance and loose armor wires.

Consequently, by eliminating the cusp-like voids between the first armor layer and the core, the assembly will be practically incompressible and much more stable for the application of subsequent armor layers. Furthermore, since the armor wires are heated before being applied they are elongated due to their thermal expansion. Hence, as they cool they are shortened applying a stress which produces pressure on the core from the first armor layer and a pressure of subsequent armor layers on the underlying layer. The result of this is that the cable produced is very tight, which from the operational point of view is desirable.

While the foregoing description is drawn to a specific embodiment of the invention, those persons skilled in the subject matter will understand that changes in form and detail will be included in the scope and extent of the present invention.

I claim:

1. A method of forming a cable including the steps of drawing a cable core through a first working station, drawing a plurality of armor wires from a rotatable bank of wires also to pass through said station, heating said armor wires prior to their arrival at said working station, winding said armor wires around said core at said working station to form a composite cable and causing the cooling wires to shrink fit on to the core.

2. A method of forming a cable according to claim 1, wherein the composite cable formed at the working station is subsequently force cooled.

3. A method of forming a cable as claimed in claim 1, wherein the formed composite cable is drawn through a second working station and a second layer of armor wires is similarly wound around the formed composite at said second station.

4. A method of forming a cable according to claim 3, wherein the armor wires wound at the second working station are wound in the direction opposite to the direction of winding of the armor wound at the first working station.

5. A method of forming a cable according to claim 1, wherein the armor wires wound on the core are heated to a temperature equal to the melting temperature of said core.

6. A method of forming a cable including the steps of drawing a cable core sequentially through first and second working stations, leading a plurality of armor wires to said first working station, heating said armor wires prior the their arrival at said first working station, winding said armor wires around said core at said first working station to form a composite cable, causing the cooling armor wires to shrink fit on to said core, leading a plurality of additional armor wires to said second working station, heating said additional wires prior to their arrival at said second working station, winding said additional wires around said composite cable and causing said cooling additional wires to shrink fit thereon to form a multi-layered cable.

7. Apparatus for forming a cable including a reel for supplying a cable core, a first working station comprising a first preforming head and a first closing die, a first rotatable bank for supplying a plurality of first armor wires to said first working station for winding around said core, means for heating said first armor wires between said first bank and said first working station, a second working station comprising a second preforming head and a second closing die, a second rotatable bank for supplying a plurality of second armor wires to said second working station for winding around the wound first armor wires, means for heating said second armor wires between said second rotatable bank and said second working station, means for drawing the core and armor wires through said first and second working stations, and take up means for accommodating the wound cable.

* * * * *